US006477348B2

(12) United States Patent
Miyamoto et al.

(10) Patent No.: US 6,477,348 B2
(45) Date of Patent: Nov. 5, 2002

(54) IMAGE FORMING APPARATUS

(75) Inventors: Takayuki Miyamoto, Shizuoka-ken; Hideyuki Yano, Mishima; Kazuhiro Funatani; Kenji Watanabe, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/527,692

(22) Filed: Mar. 17, 2000

(65) Prior Publication Data

US 2002/0094217 A1 Jul. 18, 2002

(30) Foreign Application Priority Data

Mar. 19, 1999 (JP) ..... 11-076627
May 26, 1999 (JP) ..... 11-146001
Mar. 10, 2000 (JP) ..... 2000-067361

(51) Int. Cl.[7] ..... G03G 15/01
(52) U.S. Cl. ..... 399/299
(58) Field of Search ..... 399/299, 300, 399/302, 308, 312, 313

(56) References Cited

U.S. PATENT DOCUMENTS 5,153,654 A 10/1992 Yuminamochi et al.
5,177,549 A 1/1993 Ohtsuka et al.
5,264,902 A 11/1993 Suwa et al.
5,376,999 A * 12/1994 Hwang ..... 399/299
5,519,475 A 5/1996 Miyamoto et al.
5,671,472 A * 9/1997 Snelling ..... 399/308
5,678,149 A * 10/1997 Takekoshi et al. ..... 399/299
5,805,967 A * 9/1998 DeBock et al. ..... 399/299
5,842,095 A * 11/1998 Kitamura ..... 399/299
5,860,051 A 1/1999 Goto et al. ..... 399/529
5,862,435 A 1/1999 Suzumi et al. ..... 399/68
5,974,281 A 10/1999 Fujii et al. ..... 399/66
6,026,268 A 2/2000 Shiozawa et al. ..... 399/297
6,088,565 A * 7/2000 Jia et al. ..... 399/302

FOREIGN PATENT DOCUMENTS

JP 9-288396 11/1997

* cited by examiner

*Primary Examiner*—Sandra Brase
(74) *Attorney, Agent, or Firm*—Fitzpatrick, Cella, Harper & Scinto

(57) ABSTRACT

An image forming apparatus including a plurality of image bearing members for bearing respective color images, and a transfer material bearing member for bearing and conveying a transfer material, wherein, at transfer positions where the image bearing members are contacted with the transfer material bearing member, the images on the image bearing members are successively transferred electrostatically onto the transfer material born on the transfer material bearing member in a superimposed fashion, and wherein a transfer material conveying path defined by the transfer material bearing member including the transfer positions is protruded toward a side opposite to a side on which the image bearing members are provided.

46 Claims, 9 Drawing Sheets

IMAGE FORMING APPARATUS

BACKGROUND OF THE INVENTION

1. Field of the Invention

The present invention relates to an image forming apparatus using an electrophotographic process, for example, an image forming apparatus such as a copying machine, a printer, a facsimile and the like.

2. Related Background Art

In recent years, as color image forming apparatuses of electrophotographic process type have come into wide use, not only high print quality of a color image but also high speed color output have been requested more and more. In order to meet such request, several image forming processes have been proposed.

Among such processes, there is an image forming process of so-called tandem type in which black (Bk), cyan (C), magenta (M) and yellow (Y) toner images are formed on drum-shaped image bearing members respectively and the toner images are successively transferred onto a transfer material conveyed by a transfer conveying belt by respective transfer means and then the transferred toner images are fixed to the transfer material.

An example of the conventional color image forming apparatus of tandem type is disclosed in Japanese Patent Application Laid-open No. 9-288396. FIG. 8 shows such a color image forming apparatus of tandem type.

In this color image forming apparatus, a transfer material cassette 21 is mounted to a lower part of a main body of the image forming apparatus. Transfer materials contained in the transfer material cassette 21 are picked up one by one by a pick-up roller 22 and the picked-up transfer material is fed to an image forming portion by pairs of rollers 23*a*, 23*b*.

In the image forming portion, a transfer conveying belt (transfer material bearing member) 4 for conveying the transfer material is extended around a plurality of rollers (rotary members) 16, 17, 18, 19, so as to move in a sheet feeding direction (from right to left in FIG. 8) and, at a most upstream side of the belt, the transfer material is electrostatically adsorbed onto the transfer conveying belt 4 by an adsorbing roller portion 10 to which bias is applied. Further, four drum-shaped image bearing members (referred to as "photosensitive drums" hereinafter) 1 are arranged in a line and opposite to the conveying surface of the belt, thereby forming the image forming portion.

Around each photosensitive drum 1, and in the vicinity of the peripheral surface of the photosensitive drum 1, there are disposed a charger 2, a developing device 3, and transfer means 5 which is opposed to the corresponding photosensitive drum with the conveying surface of the transfer conveying belt 4 interposed therebetween. Bk toner, C toner, M toner and Y toner are contained in frames of the developing devices 3, respectively, in order from an upstream side (from the right). Further, between the charger 2 and the developing device 3, there is provided a predetermined gap through which exposure light from exposure means 6 is illuminated onto the peripheral surface of the corresponding photosensitive drum 1.

In this color image forming apparatus, when the transfer conveying belt 4 is rotatively moved in an anti-clockwise direction (FIG. 8) to convey the transfer material, the peripheral surfaces of the photosensitive drums 1 are uniformly charged with predetermined charges by the respective chargers 2, and the charged peripheral surfaces of the photosensitive drums 1 are exposed by the respective exposure means 6 in response to image information thereby to form electrostatic latent images on the drums, and toners from the developing devices 3 are transferred to low potential portions of the electrostatic latent images to visualize the latent images as toner images. The toner images formed on the peripheral surfaces of the photosensitive drums 1 are transferred onto the conveyed transfer material by attraction of charges created on the transfer material by transfer electric fields generated by the respective transfer means 5. The toner images transferred to the transfer material are thermally fixed to the surface of the transfer material in a fixing portion 7 comprising a pressure roller and a heating roller. Thereafter, the transfer material is discharged out of the image forming apparatus by a pair of discharge rollers 8.

By the way, in the color image forming apparatus having the plurality of photosensitive drums 1, in order to ensure that the transfer conveying belt 4 is surely contacted with the photosensitive drums 1 at the transfer portions, support rollers 9 for supporting the transfer conveying belt 4 against the photosensitive drums 1 are provided between the transfer means 5 and the transfer means 5.

Now, image forming modes will be described. The image formation is not always effected with multi-color or full-color, but monochromatic printing (printing with black color) is also effected frequently. To cope with such circumstances, there has been proposed a color image forming apparatus of tandem type in which full-color printing and monochromatic printing can be switched from one to the other.

In such an apparatus, as shown in FIGS. 9A and 9B, by integrally rotating transfer portions other than a black transfer portion together with a transfer conveying belt 11 around a support roller 12 which is contacted with an inner surface of the transfer conveying belt 11 and which is disposed at an upstream side of a black image forming portion 14 (most downstream image forming portion in a transfer material feeding direction), an advancing path extending from a transfer material adsorbing portion 13 through the black image forming portion 14 to a fixing portion 15 is not changed between a full-color printing mode (FIG. 9A) and a monochromatic printing mode (FIG. 9B), thereby providing stable conveying performance in the both modes.

However, in the color image forming apparatus described in connection with FIG. 8, although the transfer conveying belt 4 can positively be contacted with the photosensitive drums 1 by supporting the inner surface of the transfer conveying belt 4 by the support rollers 9, several protruded portions are generated on the outer surface (on an upper side on which the photosensitive drums are provided) of the transfer conveying belt 4 by the presence of the support rollers, and, at such protruded portions, the transfer material (electrostatically adsorbed at the adsorbing roller portion 10) may be separated or peeled from the transfer conveying belt 4 due to rigidity of the transfer material itself. In such a case, the transfer material may not be fed to the next transfer portion properly to cause jam of the transfer material, or, the conveying distance of the transfer material may be changed due to the peeling of the transfer material, thereby the transferring may be effected at the next transfer portion at a timing different from the proper image forming timing, which leads to misregister of color to deteriorate the image quality.

Further, since it is very difficult to eliminate eccentricity of each support roller 9 completely in the manufacturing process, the transfer conveying belt 4 is moved up and down between the transfer portions to change the conveying distance of the transfer material, thereby causing the misregister of color. Further, due to repeated stress caused by the support rollers 9, a service life of the transfer conveying belt 4 is reduced.

If the support rollers 9 are positioned not to generate the protruded portions on the transfer conveying belt 4 so as to avoid the above-mentioned phenomenon, positive and stable contact between the transfer conveying belt 4 and the photosensitive drums 1 may not be achieved.

Further, regarding members (for example, support rollers 9) contacted with the transfer conveying belt 4 between the transfer portions, an electrical condition must be devised. For example, if metallic rollers merely grounded electrically are used, transfer current will flow to the metallic rollers (and then to the earth) through the inner surface of the belt 4, thereby causing poor transferring; whereas, if the rollers are maintained to a floating condition, charges are accumulated.

Further, also regarding the image forming apparatus in which the full-color printing mode and the monochromatic printing mode can be switched and which was described in connection with FIGS. 9A and 9B, similarly, a protruded portion is generated on the transfer conveying belt at the support roller 12, which arises the above-mentioned problems regarding the conveyance of the transfer material.

SUMMARY OF THE INVENTION

An object of the present invention is to provide an image forming apparatus which can prevent misregister of color in images formed on a transfer material while effectively transferring the images onto the transfer material born on a transfer material bearing member.

Another object of the present invention is to provide an image forming apparatus which can prevent a transfer material from being peeled or separated from a transfer material bearing member.

A further object of the present invention is to provide an image forming apparatus in which images can effectively be transferred from image bearing members onto an intermediate transfer member.

The other objects and features of the present invention will be apparent from the following detailed explanation referring to the accompanying drawings.

DESCRIPTION OF THE PREFERRED EMBODIMENTS

The present invention will now be explained in connection with embodiments thereof with reference to the accompanying drawings.

Embodiment 1

Figure 1:
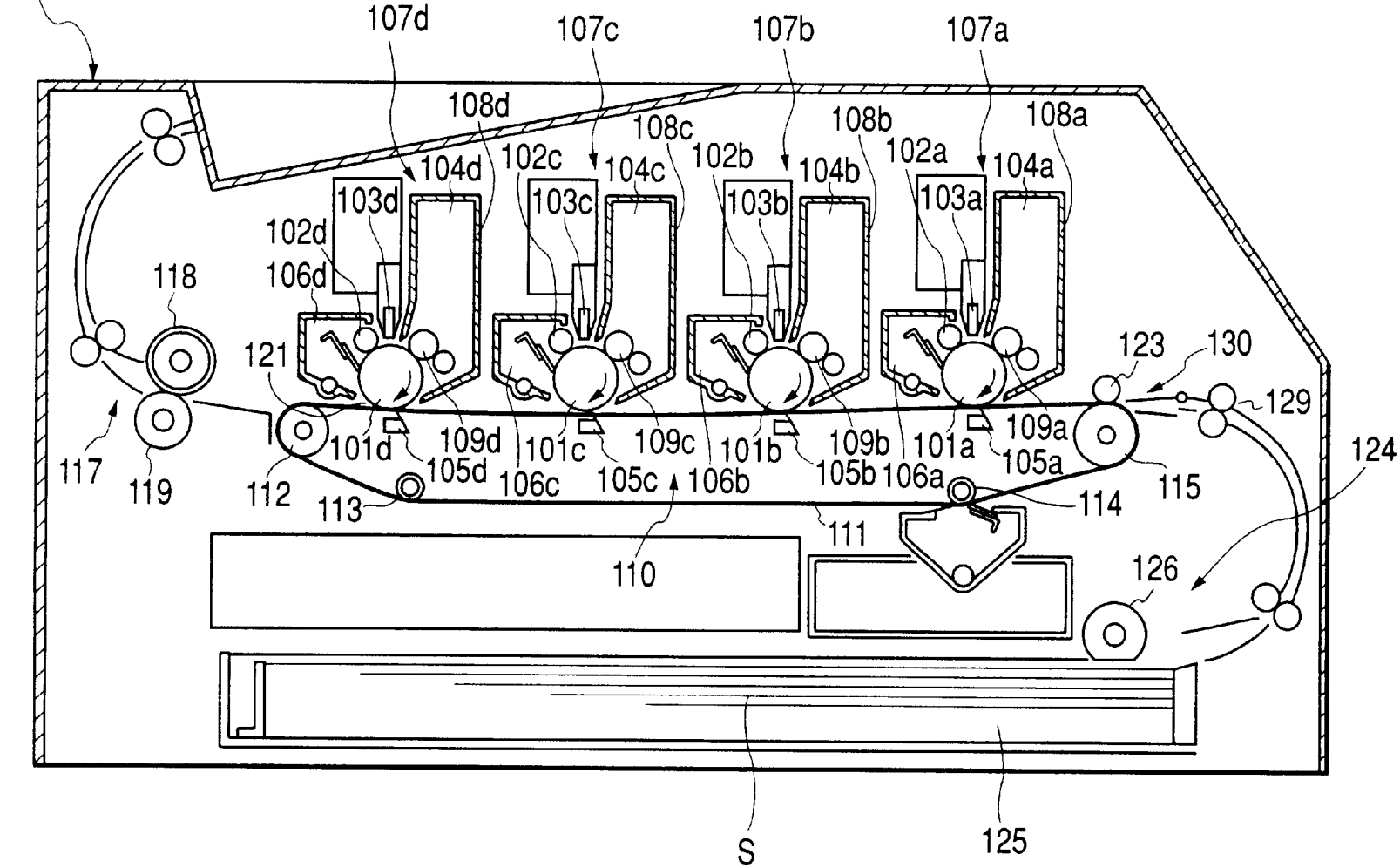
FIG. 1 is a constructural view showing a color image forming apparatus according to an embodiment 1 of the present invention.

FIG. 1 shows a color image forming apparatus according to a first embodiment of the present invention.

Figure 2:
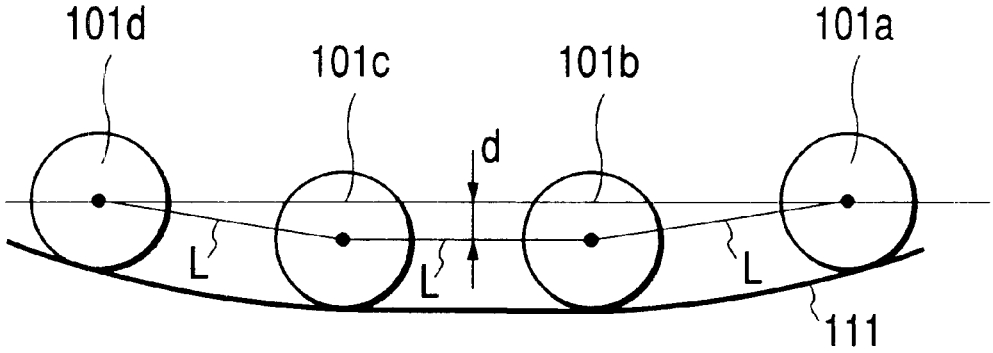
FIG. 2 is a view for explaining one of characteristics of the present invention.

In a color image forming apparatus 100 shown in FIG. 1, four photosensitive drums (drum-shaped image bearing members) 101*a*, 101*b*, 101*c*, 101*d* having the same diameter are arranged in a line, and two inner photosensitive drums 101*b*, 101*c* are protruded toward a transfer conveying belt (transfer material bearing member) 111 by a distance d of about 1 mm with respect to two outer photosensitive drums 101*a*, 101*d* (refer to FIG. 2).

Further, uppermost points (on a side on which the photosensitive drums are disposed) (i.e., positions at which windings of the belt on the rollers are terminated) of rollers 115, 112 for supporting and stretching the transfer conveying belt 111 are selected to be set on substantially the same level as lowermost points (positions contacted with the belt) of the photosensitive drums 101*a*, 101*d*.

The photosensitive drums 101*a* to 101*d* are rotated in clockwise directions in FIG. 1 by drive means (not shown). Around the photosensitive drums 101*a* to 101*d*, there are disposed, in order along rotational directions thereof, charging means 102*a*, 102*b*, 102*c*, 102*d* for uniformly charging surfaces of the photosensitive drums 101*a* to 101*d*, exposure means 103*a*, 103*b*, 103*c*, 103*d* for illuminating laser beams in response to image informations to form electrostatic latent images on the photosensitive drums 101*a* to 101*d*, developing means 104*a*, 104*b*, 104*c*, 104*d* for visualizing the electrostatic latent images as toner images by adhering toner to the electrostatic latent images, transfer means (transfer blades) 105*a*, 105*b*, 105*c*, 105*d* for transferring the toner images formed on the photosensitive drums 101*a* to 101*d* onto a transfer material, and cleaning means 106*a*, 106*b*, 106*c*, 106*d* for removing residual toners remaining on the photosensitive drums 101*a* to 101*d* after the transferring.

Incidentally, the photosensitive drums 101*a* to 101*d*, charging means 102*a* to 102*d*, developing means 104*a* to 104*d* and cleaning means 106*a* to 106*d* are integrally incorporated into respective cartridge units, thereby forming process cartridges 107*a*, 107*b*, 107*c*, 107*d* (as image forming portions) which are detachably mountable to a main body of the image forming apparatus.

Now, the constructural parts will be fully described.

Each of the photosensitive drums 101*a* to 101*d* is constituted by coating an organic photoconductor layer (OPC) on an outer surface of an aluminum cylinder having a diameter of 30 mm. Each of the photosensitive drums 101*a* to 101*d* has both ends rotatably supported by flanges and is rotated in the clockwise direction by transmitting a driving force from a drive motor (not shown) to one end of the drum.

The charging means 102*a* to 102*d* comprise conductive rollers which are contacted with the surfaces of the photosensitive drums 101*a* to 101*d*. By applying charge bias voltages from power supplies (not shown) to the rollers, the surfaces of the photosensitive drums 101*a* to 101*d* are negatively charged uniformly.

Each of the exposure means 103*a* to 103*d* comprises an LED array having a tip end to which a SELFOC (trade name) lens is mounted and the lightening of the exposure means is controlled by a drive circuit (not shown) in response to an image signal.

The developing means 104*a* to 104*d* comprise toner containing portions 108*a*, 108*b*, 108*c*, 108*d* containing yellow, magenta, cyan and black color toners, respectively, and developing rollers 109*a*, 109*b*, 109*c*, 109*d* adjacent to the surfaces of the photosensitive drums 101*a* to 101*d* and driven rotatively by driving portions (not shown) and adapted to effect development by applying developing bias voltages from developing bias power supplies (not shown) to the rollers.

Transfer material conveying means 110 comprise the transfer conveying belt 111 stretched and supported by four rollers (rotary members) 112, 113, 114, 115 and opposed to the photosensitive drums 101*a* to 101*d*. The transfer conveying belt 111 is preferably formed from an endless film member having a thickness of 100 to 150 $\mu$m and having volume resistivity of $10^7$ to $10^{14}$ $\Omega\cdot$cm (based on JIS (Japanese Industrial Standard) K6911 and measured at a temperature of 23.5° C., relative humidity of 60% and applied voltage of 100 V (which may be changed appropriately)).

The transfer conveying belt 111 is rotatively moved by the drive roller 112 so that a transfer material S electrostatically adsorbed on an outer surface (opposed to the photosensitive drums 101*a* to 101*d*) of the belt is contacted with the photosensitive drums 101*a* to 101*d*. As a result, the transfer material S is successively conveyed, by the transfer conveying belt 111, to respective transfer positions, where the toner images on the photosensitive drums 101*a* to 101*d* are successively transferred onto the transfer material in a superimposed fashion.

The transfer blades 105*a* to 105*d* are arranged side by side to be contacted with the inner surface of the transfer conveying belt 111 and to be opposed to four photosensitive drums 101*a* to 101*d*, respectively. The transfer blades 105*a* to 105*d* are connected to the transfer bias power supplies (not shown). By applying voltages having positive polarity to the transfer blades 105*a* to 105*d* to generate electric fields, the toner images having negative polarity on the photosensitive drums 101*a* to 101*d* are successively transferred onto the transfer material S being contacted with the photosensitive drums 101*a* to 101*d*.

Adsorbing means 130 is positioned at a most upstream side of the transfer conveying belt 111 and comprises an adsorbing roller 123 and the roller 115 which serve to pinch the transfer conveying belt 111 and the transfer material S therebetween and to electrostatically adsorb the transfer material S to the transfer conveying belt 111. In this case, by applying adsorbing bias voltage to the adsorbing roller 123, an electric field is generated between the adsorbing roller 123 and the opposed roller 115 (which is grounded), thereby creating an electrostatic adsorbing force due to dielectric polarization between the transfer conveying belt 111 and the transfer material S which are dielectric materials.

A sheet feeding portion 124 serves to feed the transfer material S to the image forming portions and comprises a sheet feeding cassette 125 containing a plurality of transfer materials S. In the vicinity of the sheet feeding cassette 125, there is provided a rotatable pick-up roller 126 for picking up the transfer materials S one by one, and the pick-up roller is rotated intermittently by a drive motor (not shown).

A fixing portion 117 serves to fix the plurality of toner images transferred to the transfer material S to the transfer material and comprises a rotatable drive heating roller 118, and a pressure roller 119 urged against the heating roller and adapted to apply heat and pressure to the transfer material.

Next, a full-color mode for forming a full-color image in the color image forming apparatus will be explained.

In the image formation, the pick-up roller or semi-circular roller 126 is rotatingly driven in response to the image forming operation, with the result that the transfer materials are separated and picked up one by one from the sheet feeding cassette 125. A leading end of the picked-up transfer material abuts against a nip of a pair of registration rollers 129 and is temporarily stopped there. A waiting condition for waiting the sheet feeding timing is maintained while forming a loop in the transfer material.

On the other hand, in synchronous with the above operation, the process cartridges 107*a* to 107*d* are driven in response to the printing timing, with the result that the photosensitive drums 101*a* to 101*d* are rotated in the clockwise directions. Then, the exposure means 103*a* to 103*d* corresponding to the process cartridges 107*a* to 107*d* are successively driven. As a result, the charging rollers 102*a* to 102*d* give uniform negative charges to the peripheral surfaces of the photosensitive drums 101*a* to 101*d*, and the exposure means 103*a* to 103*d* effect exposure of the peripheral surfaces of the photosensitive drums 101*a* to 101*d* in response to the image signals, thereby forming the electrostatic latent images on the peripheral surfaces of the photosensitive drums 101*a* to 101*d*. The developing rollers 109*a* to 109*d* transfer the toners to the low potential portions (exposed portions) of the electrostatic latent images to form the toner images on the peripheral surfaces of the photosensitive drums 101*a* to 101*d*. That is, the developments are effected.

The pair of registration rollers 129 starts to rotate at a timing so that a leading end of the toner image on the most upstream photosensitive drum 101*a* is rotatively brought into a print starting position of the transfer material S at the contact position between the photosensitive drum 101*a* and the transfer conveying belt 111, thereby feeding the transfer material S waiting in the looped state to the adsorbing means 130.

The transfer material S is urged against the outer surface of the transfer conveying belt 111 to be pinched between the adsorbing roller 123 and the transfer conveying belt 111, and, by applying the voltage between the transfer conveying belt 111 and the adsorbing roller 123, charges are created in the transfer material S (dielectric member) and the dielectric layer of the transfer conveying belt 111, thereby electrostatically adsorbing the transfer material S on the outer surface of the transfer conveying belt 111. As a result, the transfer material S is stably adsorbed to the transfer conveying belt 111 and is conveyed to the most upstream transfer portion.

By the electric field generated between the photosensitive drum 101*a* and the transfer blade 105*a*, the toner image on the photosensitive drum 101*a* is transferred onto the transfer material S conveyed to the most upstream transfer portion, and then, the transfer material is conveyed to the next transfer portion, where the toner image is similarly transferred onto the transfer material in a superimposed fashion. Similarly, the transfer material is successively conveyed to the downstream transfer portions, with the result that four toner images are transferred onto the transfer material in a superimposed fashion.

The transfer material S to which the four toner images are transferred is separated from the transfer conveying belt 111 by curvature of the drive roller 112 and rigidity of the transfer material S, and the separated transfer material is conveyed to the fixing portion 117.

According to the illustrated embodiment, in a transfer material conveying path from the adsorbing means 130 to the fixing portion 117, two inner photosensitive drums 101*b*, 101*c* are protruded toward the transfer conveying belt 111 by a distance d of about 1 mm with respect to two outer photosensitive drums 101*a*, 101*d*. That is to say, as shown in FIG. 2, a group of line segments including line segments L connecting between centers of the adjacent photosensitive drums 101*a* to 101*d* are protruded in a trapezoidal form toward the transfer conveying belt 111. In order to prevent jam of the transfer material S and to prevent the fact that-areas (transfer portions) of the transfer conveying belt 111 electrostatically adsorbed to the photosensitive drums 101*a* to 101*d* become too long so that the toner images once transferred to the transfer conveying belt 111 are distorted while being passed through the transfer portions, the value of the distance d is preferably 0.5 to 5 mm (when manufacturing and assembling errors are neglected).

With the arrangement as mentioned above, unlike to the aforementioned conventional techniques, the transfer conveying belt 111 can positively be contacted with the photosensitive drums 101*a* to 101*d* at the transfer portions, without lifting and supporting the transfer conveying belt 111 by the support rollers 9. That is to say, the lengths of the transfer portions in the moving direction of the transfer conveying belt 111 can be maintained properly.

Further, when the transfer bias voltages are applied to the transfer blades 105*a* to 105*d*, the electrostatic adsorbing forces act between the transfer conveying belt 111 and the photosensitive drums 101*a* to 101*d*. Therefore, when the transfer material enters into the transfer portions, entering loads are created more or less. If such entering load is great, the transfer material S may be slipped on the transfer conveying belt 111, with the result that misregister of color will occur when the color images are superimposed. In the arrangement according to the illustrated embodiment, ranges where the transfer conveying belt 111 is mechanically contacted with the photosensitive drums 101*a* to 101*d* slightly can be formed in the areas against which the electric fields do not act directly at the upstream side of the transfer portions, so that the entering loads of the transfer material can be reduced, thereby preventing misregister of color.

Further, unlike to the conventional techniques, since it is not required for providing support rollers 9, no portion protruded toward the transfer material is formed on the surface of the transfer conveying belt 111 with which the transfer material is contacted. That is to say, the transfer material S electrostatically adsorbed to the transfer conveying belt 111 by the adsorbing roller 123 is securely adsorbed to the transfer conveying belt while the transfer material is being passed through the transfer portions.

Incidentally, in the illustrated embodiment, since the recessed bending of the transfer conveying belt 111 regarding the transfer material acts to urge the transfer material S against the transfer conveying belt 111 by the rigidity of the transfer material, such bending is advantageous for the stable conveyance.

In the fixing portion 117, the transfer material S to which the toner images from the photosensitive drums 101*a* to 101*d* have been transferred is conveyed by the pair of fixing rollers 118, 119 and is subjected to heat and pressure from the pair of fixing rollers 118, 119. As a result, the plural color toner images are fixed to the surface of the transfer material S.

Next, the black printing (monochromatic printing) mode for forming a black-and-white image will be described.

Figure 3:
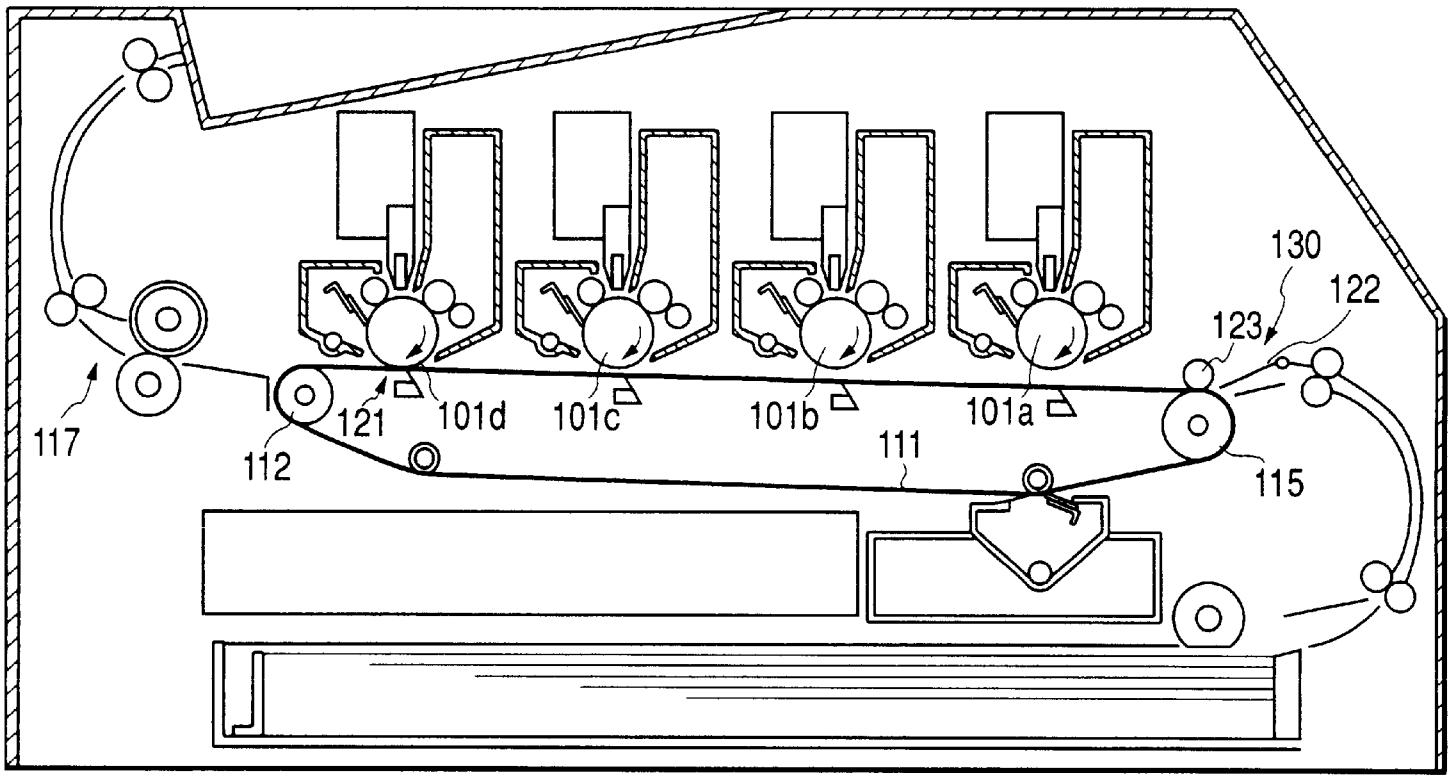
FIG. 3 is a view showing a monochromatic printing mode in the color image forming apparatus of FIG. 1.

FIG. 3 is a view showing a condition of the image forming portions when the black printing is effected. The switching from the full-color printing mode to the monochromatic printing mode and vice versa is effected by a cam (not shown) having a drive source. Around the drive roller 112 (for the transfer conveying belt 111) near the black printing portion (most downstream image forming portion in the transfer material conveying direction) 121, by rotating the driven roller 115 remotest from the black printing portion 121 to be retreated from the photosensitive drum by the cam and then by stopping the driven roller in a predetermined position, a state that only the black printing portion 121 is contacted with the transfer conveying belt 111 and the photosensitive drums 101*a*, 101*b*, 101*c* are spaced apart from the transfer conveying belt 111 at the other transfer portions (for yellow, magenta and cyan colors) is established.

According to the illustrated embodiment, in the transfer material conveying path from the adsorbing means 130 to the fixing portion 117, by arranging the two inner photosensitive drums 101*b*, 101*c* to protrude toward the transfer conveying belt 111 by the distance d of about 1 mm with respect to the outer two photosensitive drums 101*a*, 101*d* and, as mentioned above, by retreating the driven roller 121 (remotest from the black printing portion 121) from the photosensitive drum 101*a* around the drive roller 112 (for the transfer conveying belt 111) near the black printing portion 121 in the black printing mode, no protruded portion toward the transfer material S is formed on the transfer conveying belt 111. Incidentally, so long as the effect of the present invention can be achieved, i.e., so long as the transfer material S electrostatically adsorbed to the transfer conveying belt 111 by the adsorbing roller 123 is surely adsorbed to the transfer conveying belt while the transfer material is being passed through the transfer portions, for example, only the photosensitive drum 101*b* or only the photosensitive drum 101*c* may be protruded toward the transfer conveying belt 111.

Incidentally, the switching between the full-color printing mode and the monochromatic printing mode may be effected by a CPU (control means) (not shown).

Further, since the transfer material conveying path from the black printing portion 121 to the fixing portion 117 in the monochromatic printing mode is not changed from the transfer material conveying path in the full-color printing mode, the stable fixing ability can be obtained.

Incidentally, in this case, although a nip between the photosensitive drum 101*d* and the transfer conveying belt 111 at the black printing portion 121 in the full-color printing mode slightly differs from that in the monochromatic printing mode, by utilizing a narrow area transfer system in which an area where the transfer electric field is formed by the transfer blade is made narrower, influence of such difference can be reduced. Further, by changing the transfer bias voltage applied to the black printing portion 121 in the full-color printing mode from that in the monochromatic printing mode, the difference can be reduced.

Further, with this arrangement, the position of the transfer material adsorbing portion may be changed between the full-color printing mode and the monochromatic printing mode. However, since the transfer material conveying path before image formation does not affect an influence upon the image, the degrees of freedom is relatively great, so that, even with this arrangement, countermeasure for such change can easily be done. For example, as shown in FIG. 3, by providing a rocking guide plate 122 having a fulcrum disposed at an upstream end thereof in the transfer material conveying direction, the transfer material S can surely be conveyed to the position of the transfer material adsorbing portion.

The other image forming operations in the monochromatic printing mode are fundamentally the same as those in the full-color printing mode, except that image formation on the yellow, magenta and cyan photosensitive drums is not effected and the transferring other than black color is not effected.

Embodiment 2

Figure 4:
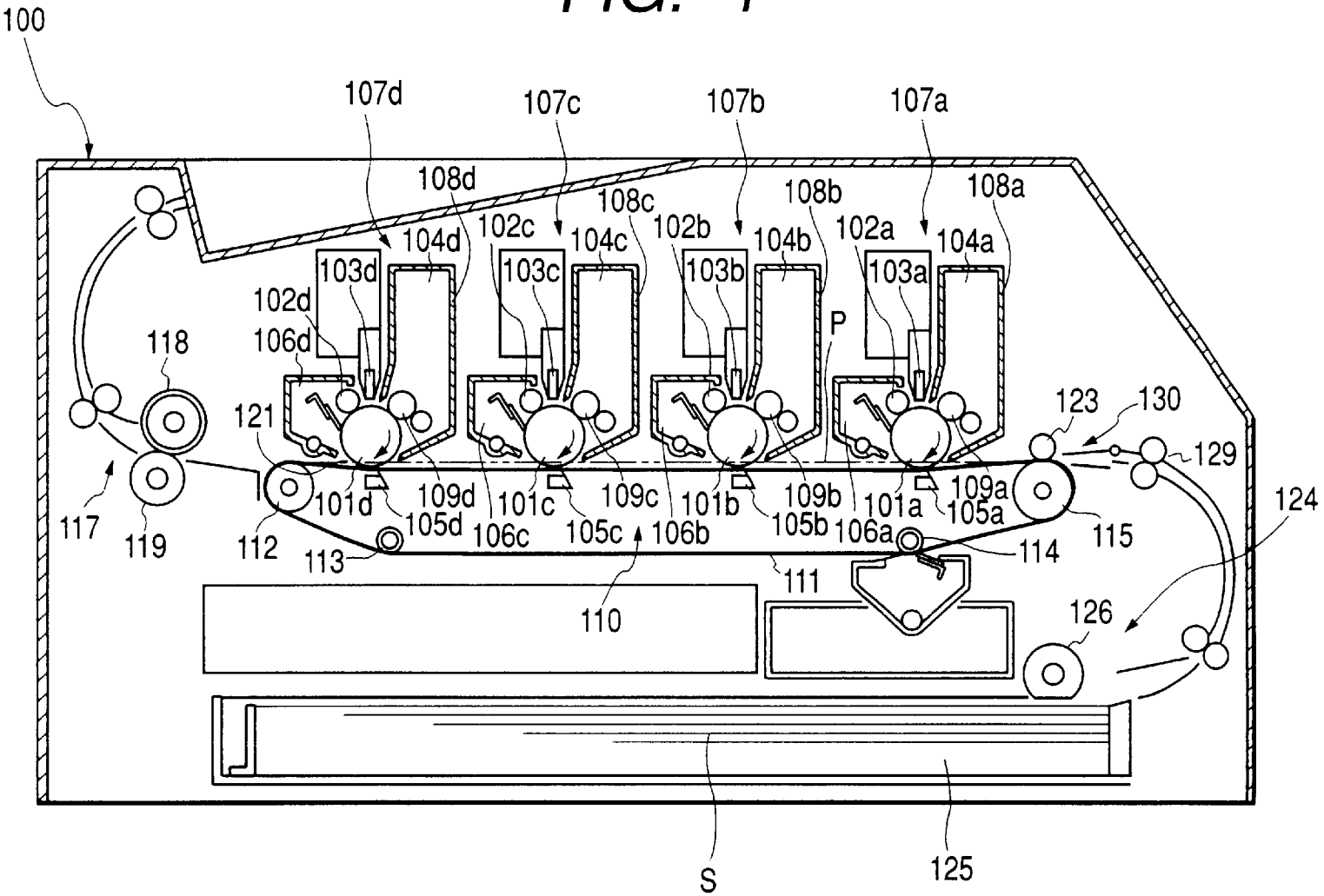
FIG. 4 is a constructural view showing a color image forming apparatus according to an embodiment 2 of the present invention.

Next, an image forming apparatus according to an embodiment 2 of the present invention will be explained with reference to FIG. 4. Incidentally, the same elements as those in the embodiment 1 are designated by the same reference numerals and explanation thereof will be omitted.

In this embodiment, as another example that the transfer material conveying path defined by the transfer conveying belt 111 is protruded toward the direction opposite to the photosensitive drum side, the rollers 112, 115 supporting the transfer conveying belt 111 are deviated by a predetermined distance toward the photosensitive drum side. That is to say, the arranged positions of the photosensitive drums 101*a* to 101*d* in the vertical direction (up-and-down direction) are substantially the same as one another, but, the uppermost points on the peripheral surfaces of the rollers 112, 115 are positioned above the lowermost points (transfer portions) on the peripheral surfaces of the photosensitive drums 101*a* to 101*d* which are contacted with the transfer conveying belt 111. In other words, as shown by the two dot and dash line in FIG. 4, a tangential line (two dot and dash line) P connecting between the uppermost points of the rollers 112, 115 extends across all of the photosensitive drums 101*a* to 101*d*. With this arrangement, contact between the most upstream photosensitive drum 101*a* and the transfer conveying belt 111 and contact between the most downstream photosensitive drum 101*d* and the transfer conveying belt 111 are surely established.

In the color image forming apparatus having the transfer conveying belt, the contacting condition between the transfer conveying belt 111 and the photosensitive drums 101 affects an influence upon the transferring performance. In this case, it is most important that the transfer conveying belt 111 is surely contacted with the photosensitive drums 101. Further, the transferring performance is enhanced when nip amounts between the transfer conveying belt 111 and the photosensitive drums 101 are increased to a certain extent. The example disclosed in the aforementioned Japanese Patent Application Laid-Open No. 9-288396 also considers such effect so that the transfer conveying belt is securely contacted with all of the photosensitive drums by the support rollers 9.

However, the transferring conditions in the color image forming apparatus of tandem type are not identical in four transfer portions, but, particularly in the most upstream transfer portion (position where the photosensitive drum 101*a* is opposed to the transfer blade 105*a*) and in the most downstream transfer portion (position where the photosensitive drum 101*d* is opposed to the transfer blade 105*d*), there are the following characteristics.

First, of all, in the most upstream transfer portion, since the transfer material is not subjected to transfer history at all, it is difficult to estimate how much potential be existed on the transfer material. Accordingly, it is important that wider margin for the transferring is maintained to cope with this.

Further, in the most downstream transfer portion, if there is relative speed difference between the transfer conveying belt 111 and the fixing portion 117 disposed at the downstream portion of the transfer portions, the contacting state between the transfer material and the photosensitive drum 101*d* is apt to become unstable due to the loop in the transfer material, which leads to deterioration of the transferring performance. Accordingly, it is important that the transfer material is surely pinched between the photosensitive drum 101*d* and the transfer conveying belt 111.

Therefore, in the four transfer portions, particularly in most upstream transfer portion and in the most downstream transfer portion, it is important that the enough nip amounts between the transfer conveying belt 111 and the photosensitive drums 101 are maintained, in order to obtain the good image.

In the illustrated embodiment, at the most upstream transfer portion and the most downstream transfer portion, the enough nip amounts between the transfer conveying belt 111 and the photosensitive drums 101 can be maintained with a simple construction, thereby to obtain the stable transfer images. Incidentally, in the illustrated embodiment, at the transfer portions other than the most upstream transfer portion and the most downstream transfer portion, the transfer conveying belt 111 is fully contacted with the photosensitive drums 101 by attracting forces (due to transfer voltages) for attracting the transfer conveying belt 111 toward the photosensitive drums 101 and rigidities (stiff) of the transfer blades.

In this way, also in this embodiment, similar to the embodiment 1, since it is not required that any support roller 9 as is in the conventional case be provided to generate the upwardly protruded portions in the transfer material conveying path of the transfer conveying belt, misregister of color can be prevented while achieving good transferring of plural color images.

Embodiment 3

Figure 5:
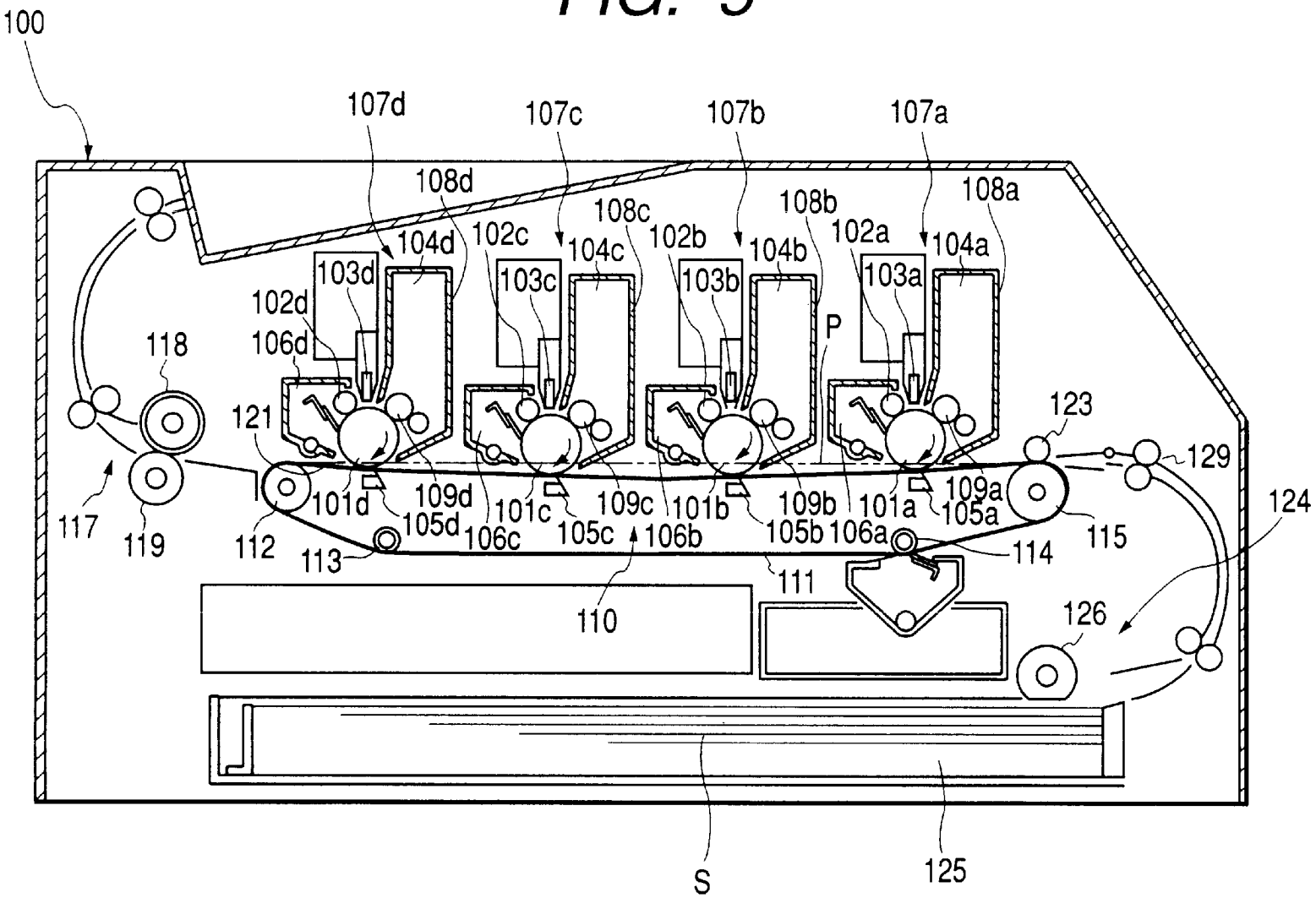
FIG. 5 is a constructural view showing a color image forming apparatus according to an embodiment 3 of the present invention.

Next, an image forming apparatus according to an embodiment 3 of the present invention will be explained with reference to FIG. 5.

Incidentally, the same elements as those in the embodiment 1 are designated by the same reference numerals and explanation thereof will be omitted.

In this embodiment, as a further example that the transfer material conveying path defined by the transfer conveying belt 111 is protruded toward the direction opposite to the photosensitive drum side, the photosensitive drums 101*b*, 101*c* are displaced downwardly toward the transfer conveying belt 111 by a distance of about 1 mm with respect to the photosensitive drums 101*a*, 101*d* and, furthermore, the uppermost points on the peripheral surfaces of the rollers 112, 115 supporting the transfer conveying belt 111 are positioned (on the side on which the photosensitive drums are disposed) above the lowermost points (transfer portions) on the peripheral surfaces of the photosensitive drums 101*a* to 101*d*.

That is to say, the tangential line P connecting between the uppermost points of the rollers 112, 115 extends across all of the photosensitive drums.

With this arrangement, in all of the transfer portions, enough lengths of the transfer nips in the moving direction of the transfer conveying belt 111 can effectively be obtained thereby to achieve good transferring of plural color images, while reducing the transfer nip entering loads of the transfer material S thereby to maintain good conveyance of the transfer material S. Further, since it is not required that any support roller 9 as is in the conventional case be provided, misregister of color due to peeling of the transfer material and/or eccentricities of the support rollers can be prevented.

Embodiment 4

Next, an image forming apparatus according to an embodiment 4 of the present invention will be explained with reference to FIG. 6.

Figure 6:
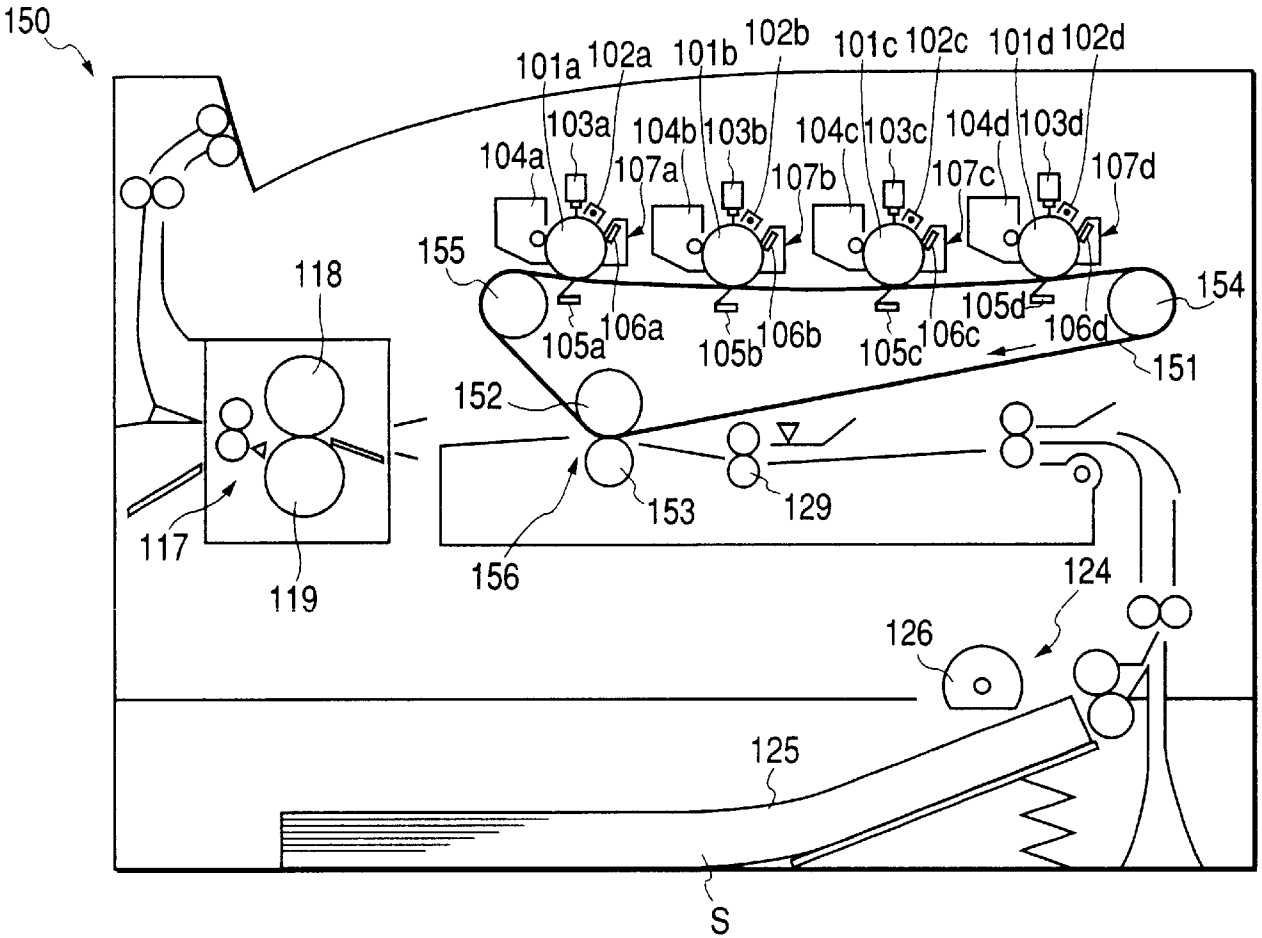
FIG. 6 is a constructural view showing a color image forming apparatus according to an embodiment 4 of the present invention.

The present invention can be applied to an image forming apparatus having an intermediate transfer member as shown in FIG. 6 also, similar to the embodiment 1.

Similar to the image forming apparatus 100, in an image forming apparatus 150 shown in FIG. 6, four photosensitive drums (drum-shaped image bearing members) 101*a*, 101*b*, 101*c*, 101*d* having the same diameter are arranged in a line, and, similar to the arrangement shown in FIG. 2, two inner photosensitive drums 101*b*, 101*c* are protruded toward an intermediate transfer belt 151 by a distance d of about 1 mm with respect to two outer photosensitive drums 101*a*, 101*d*. So long as the technical advantages of the present invention can be achieved, for example, only the photosensitive drum 101*b* or only the photosensitive drum 101*c* may be protruded toward the intermediate transfer belt 151. In order to prevent the fact that areas (transfer portions) of the intermediate transfer belt 151 electrostatically adsorbed to the photosensitive drums 101*a* to 101*d* by the transfer means 105*a* to 105*d* become too long (in a moving direction of the intermediate transfer belt) so that the toner images transferred to the intermediate transfer belt 151 are distorted while being passed through the transfer portions, the value of the distance d is preferably 0.5 to 5 mm (when manufacturing and assembling errors are neglected).

The intermediate transfer belt 151 has preferably volume resistivity of $10^7$ to $10^{14}$ Ω·cm (based on JIS (Japanese Industrial Standard) K6911 and measured at a temperature of 23.5° C., relative humidity of 60% and applied voltage of 100 V (which may be changed appropriately)). The intermediate transfer belt 151 is stretched and supported by a drive roller 154 for driving the intermediate transfer belt 151, a driven roller 155 and a secondary transferring opposed roller 152.

Since the process for forming the images on the four photosensitive drums are the same as the process in the image forming apparatus 100 according to the embodiment 1, explanation thereof will be omitted, and explanation is made from transferring of images onto the intermediate transfer belt.

When the toner image formed on the rotating photosensitive drum 101*a* is contacted with the intermediate transfer belt 151, by applying predetermined bias to transfer means 105*a* (transfer blade similar to that in the embodiment 1) disposed on an inner surface of the intermediate transfer belt 151, the toner image is primary-transferred onto the intermediate transfer belt 151. Similarly, by repeating such process at the remaining three photosensitive drums and transfer portions, four color toner images are transferred onto the intermediate transfer belt 151 in a superimposed fashion. The superimposed four color toner images are moved to a secondary transfer portion 156, where the toner images are collectively secondary-transferred, by a secondary transfer roller 153, onto the transfer material S conveyed at the predetermined timing by the pair of registration rollers 129.

Since a process for conveying the transfer material S to the secondary transfer portion 156 and a process for fixing the toner images transferred to the transfer material are the same as those in the image forming apparatus 100 according to the embodiment 1, the same elements are designated by the same reference numerals, and explanation thereof will be omitted.

Also in the image forming apparatus using the intermediate transfer belt 151, unlike to the aforementioned conventional techniques, the intermediate transfer belt 151 can be securely contacted with the photosensitive drums 101*a* to 101*d* at the transfer portions, without lifting and supporting the belt by the support rollers 9, thereby achieving the good transferring condition. Further, when the predetermined transfer bias voltages are applied to the transfer means 105*a* to 105*d*, the electrostatic adsorbing forces act between the intermediate transfer belt 151 and the photosensitive drums 101*a* to 101*d*. Therefore, when an area of the intermediate transfer belt 151 to which the toner images are transferred enters into the transfer portions, a load against the conveyance of the intermediate transfer belt 151 is created. If such a load is great, misregister of color will occur when the color images are superimposed on the intermediate transfer belt 151. In the arrangement according to the illustrated embodiment, since ranges where the intermediate transfer belt 151 is mechanically contacted with the photosensitive drums 101*a* to 101*d* slightly can be formed in the areas against which the transfer electric fields do not act directly at the upstream side of the transfer portions, the entering load created when the intermediate transfer belt 151 enters into the contact portions (transfer portions) of the photosensitive drums 101*a* to 101*d* can be reduced, thereby preventing misregister of color.

Further, the embodiment 4 is not limited to the embodiment 1, but the arrangement similar to the embodiment 2 or the embodiment 3 may be adopted. That is to say, as is in the embodiment 2, without protruding the photosensitive drums 101*b*, 101*c* downwardly, the rollers 154, 155 supporting the intermediate transfer belt may be deviated toward the side on which the photosensitive drums are disposed. Alternatively, as is in the embodiment 3, the photosensitive drums 101*b*, 101*c* may be protruded toward the intermediate transfer belt with respect to the photosensitive drums 101*a*, 101*d*, and, also, the rollers 154, 155 may be deviated toward the side on which the photosensitive drums are disposed.

With the arrangements as mentioned above, unlike to the conventional techniques, in the transfer portions, since enough lengths of the transfer portions (areas where the intermediate transfer belt is contacted with the photosensitive drums) in the moving direction of the intermediate transfer belt can be effectively formed, without lifting and supporting the intermediate transfer belt by the support rollers 9, good transferring of the color toner images can be achieved and misregister of color can be prevented.

Figure 7:
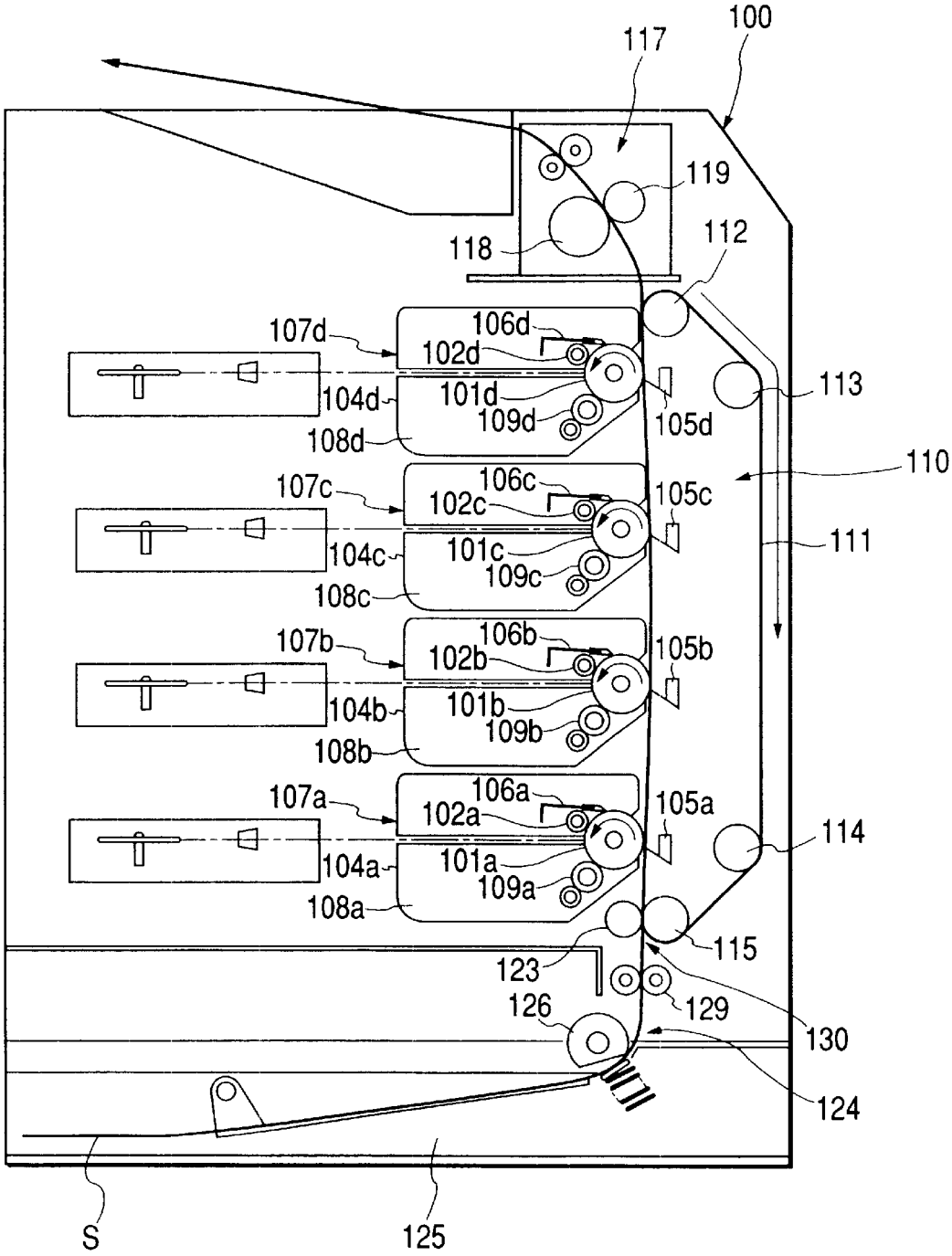
FIG. 7 is a view showing another application of the present invention.
Figure 8:
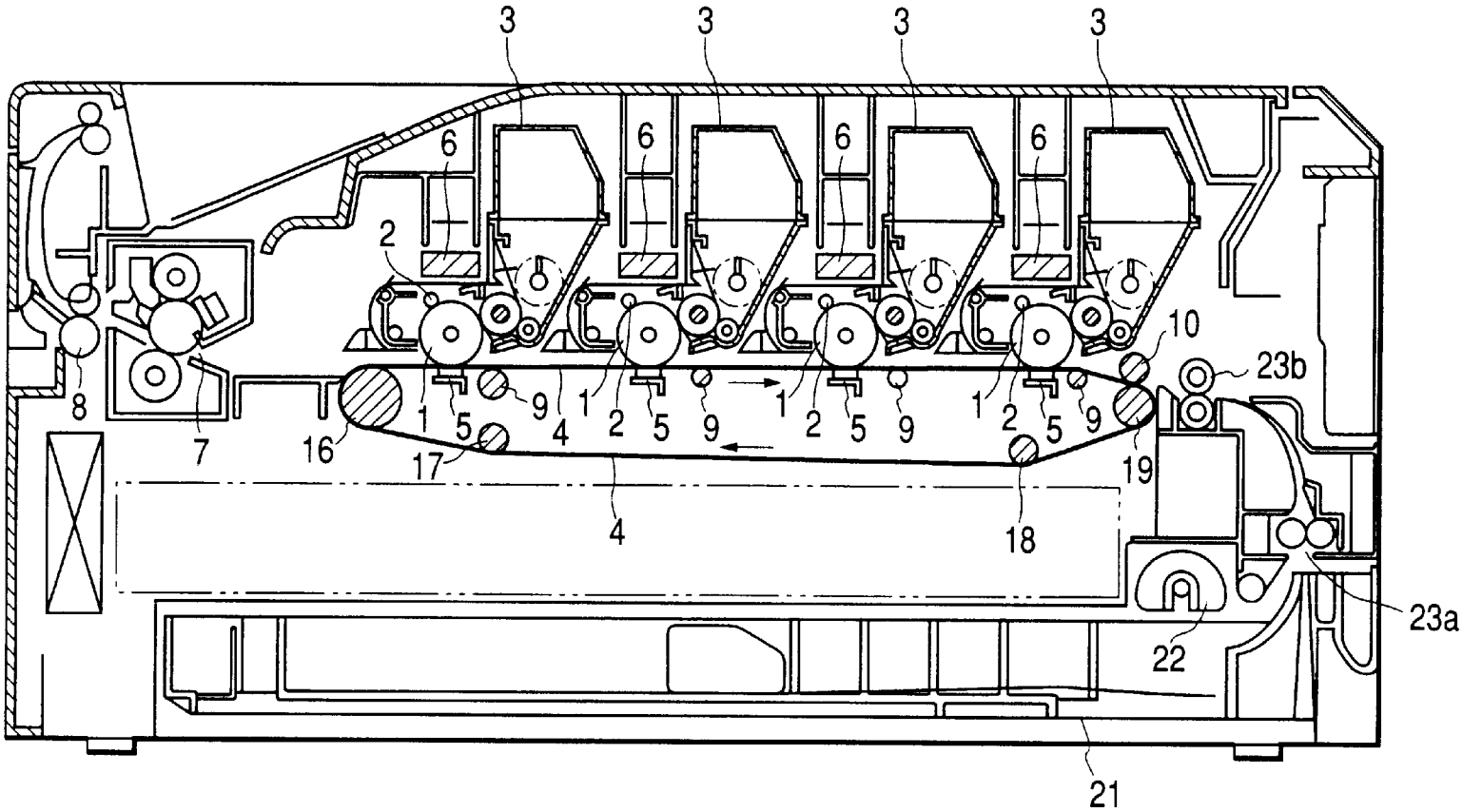
FIG. 8 is a constructural view showing a conventional color image forming apparatus.
Figure 9A:
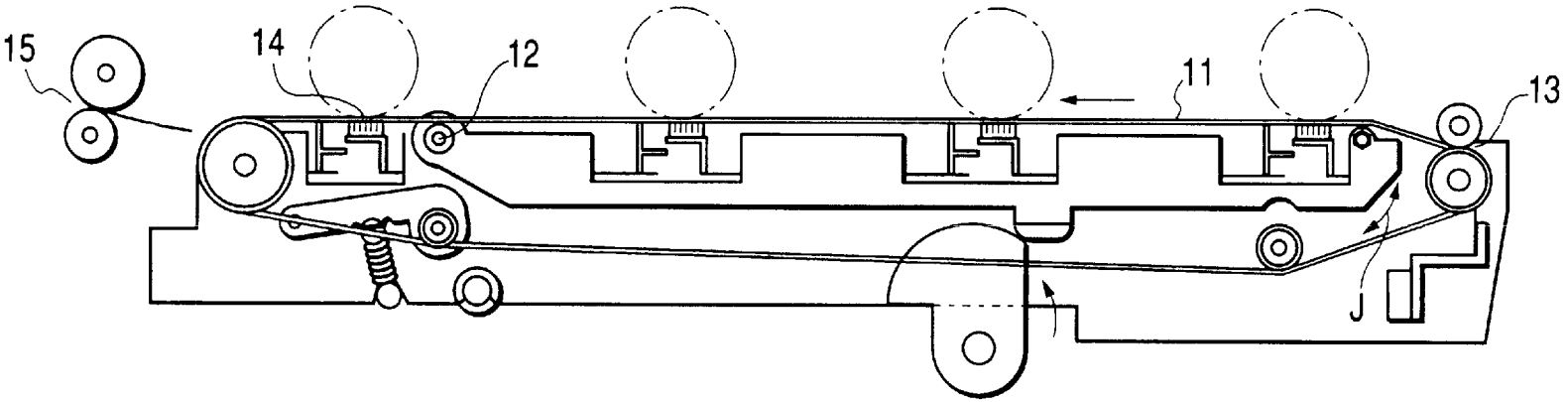
FIGS. 9A and 9B are explanatory views showing a full-color printing mode (FIG. 9A) and a monochromatic printing mode (FIG. 9B) in another conventional color image forming apparatus.
Figure 9B:
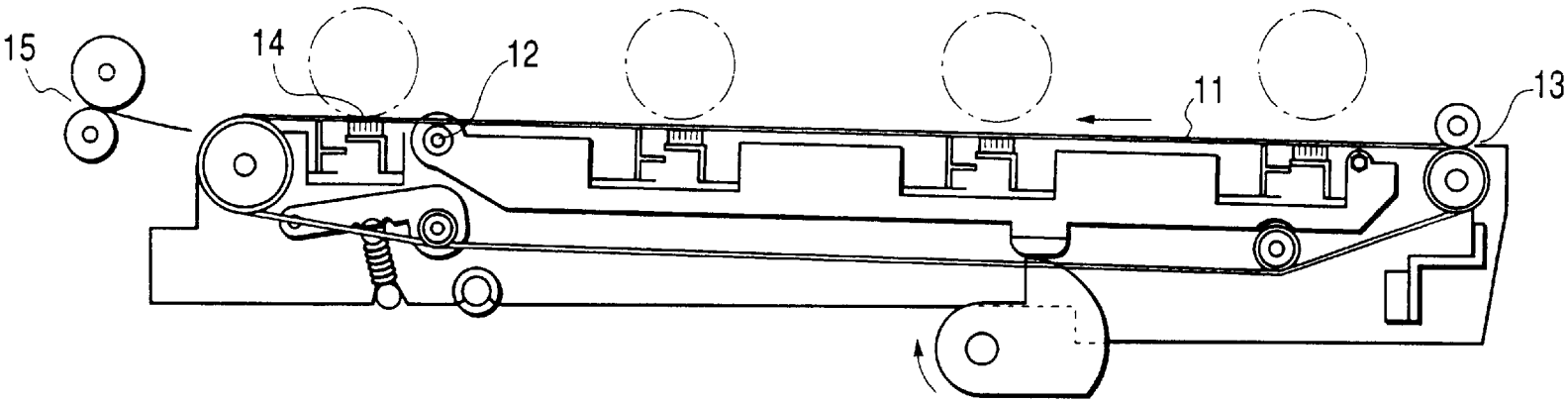

In the aforementioned embodiments, while an example that the conveying direction of the transfer material given by the transfer conveying belt 111 is from right to left in FIG. 1, for example, was explained, the conveying direction is not limited to such an example, but, as shown in FIG. 7, the transfer material may be conveyed by the transfer conveying belt 111 from down (or up) to up (or down) (i.e., substantially in a vertical direction).

Similarly, in the image forming apparatus using the intermediate transfer belt, the moving direction of the surface (defined by the rollers 154, 155) of the intermediate transfer belt to which the toner images are transferred may be from down (or up) to up (or down).

Further, in the aforementioned embodiments, while an example that the image forming apparatus utilizes the drum-shaped photosensitive members was explained, the present invention is not limited to such an example, but, the present invention can be applied to image forming apparatuses utilizing belt-shaped photosensitive member or members.

Incidentally, in the transfer portion, even if a protruded portion protruded upwardly (toward the photosensitive drum) is formed, there is no problem because an electrostatic adsorbing force for adsorbing the transfer material to the transfer conveying belt is generated in the transfer portion by the transfer electric field.

What is claimed is:

1. An image forming apparatus comprising:

a plurality of image bearing members for bearing respective color images;

a transfer material bearing member for bearing and conveying a transfer material, wherein, at transfer positions where said image bearing members are contacted with said transfer material bearing member, the images on said image bearing members are successively transferred onto the transfer material born on said transfer material bearing member;

a first rotating member for supporting said transfer material bearing member most upstream in a conveying direction of the transfer material conveyed by said transfer material bearing member; and a second rotating member for supporting said transfer material bearing member most downstream in the conveying direction, wherein a common tangent of said first rotating member and said second rotating member on an image bearing member side is positioned to be offset from and on the image bearing side of the transfer positions.

2. An image forming apparatus according to claim 1, wherein a group of lines connecting between the adjacent transfer positions is protruded toward the side opposite to the side on which said image bearing members are provided.

3. An image forming apparatus according to claim 2, wherein the images on said image bearing members are successively transferred onto the transfer material born on said transfer material bearing member in a superimposed fashion at first, second, third and fourth transfer positions.

4. An image forming apparatus according to claim 3, wherein at least one of said second and third transfer positions is positioned on a side, on which said transfer material bearing member is provided, of said first and fourth transfer positions.

5. An image forming apparatus according to claim 4, wherein, in a direction substantially perpendicular to a moving direction of said transfer material bearing member, at least one of said second and third transfer positions is deviated from said first and fourth transfer positions by a distance of 0.5 to 5 mm.

6. An image forming apparatus according to claim 1, wherein said transfer material bearing member has a belt shape.

7. An image forming apparatus according to claim 1, wherein said first and second rotating members comprise rotatable rollers.

8. An image forming apparatus according to claim 1, wherein any portion of said transfer material bearing member protruding toward said side on which said image bearing members are provided is not formed in a transfer material conveying path.

9. An image forming apparatus according to claim 1, wherein a conveying direction of the transfer material given by said transfer material bearing member includes a vertical component.

10. An image forming apparatus according to claim 9, wherein the conveying direction of the transfer material given by said transfer material bearing member is a substantially upward vertical direction.

11. An image forming apparatus according to any one of claims 1–6, 7, or 8–10, further comprising a plurality of transfer means which, upon transferring of the images, are contacted with said transfer material bearing member at said transfer positions to electrostatically transfer the images on said image bearing members onto the transfer material born on said transfer material bearing member.

12. An image forming apparatus comprising:

a plurality of image bearing members for bearing respective color images, and a transfer material bearing member for bearing and conveying a transfer material, wherein at transfer positions where said image bearing members are contacted with said transfer material bearing member, the images on said image bearing members are successively transferred electrostatically onto the transfer material born on said transfer material bearing member in a superimposed fashion, and wherein first, second and third image bearing members are provided in order along a conveying direction of the transfer material given by said transfer material bearing member, and, a second transfer position where said second image bearing member and said transfer material bearing member are contacted with each other is positioned on a side, on which said transfer material bearing member is provided, of a line connecting between a first transfer position where said first image bearing member and said transfer material bearing member are contacted with each other and a third transfer position where said third image bearing member and said transfer material bearing member are contacted with each other.

13. An image forming apparatus according to claim 12, wherein, in a direction substantially perpendicular to a moving direction of said transfer material bearing member, said second position is deviated from said first and third transfer positions by a distance of 0.5 to 5 mm.

14. An image forming apparatus according to claim 13, further comprising a fourth image bearing member disposed between said first and third image bearing members in the conveying direction of the transfer material given by said transfer material bearing member.

15. An image forming apparatus according to claim 14, wherein said second transfer position and a fourth transfer position where said fourth image bearing member and said transfer material bearing member are contacted with each other are positioned on said side, on which said transfer material bearing member is provided, of the line connecting between said first transfer position and said third transfer position.

16. An image forming apparatus according to claim 12, further comprising a fourth image bearing member disposed between said first and third image bearing members in the conveying direction of the transfer material given by said transfer material bearing member.

17. An image forming apparatus according to claim 16, wherein said second transfer position and a fourth transfer position where said fourth image bearing member and said transfer material bearing member are contacted with each other are positioned on said side, on which said transfer material bearing member is provided, of the line connecting between said first transfer position and said third transfer position.

18. An image forming apparatus according to claim 12, wherein said transfer material bearing member has a belt shape.

19. An image forming apparatus according to claim 18, further comprising first and second support members for supporting said transfer material bearing member to define a conveying path.

20. An image forming apparatus according to claim 19, wherein said first and second support members comprise rotatable rollers.

21. An image forming apparatus according to claim 20, wherein a tangential line connecting between said first and second support members on a side on which said image bearing members are provided is positioned on said side, on which said image bearing members are provided, of said transfer positions.

22. An image forming apparatus according to claim 12, wherein any portion of said transfer material bearing member protruding toward a side on which said image bearing members are provided is not formed in a conveying path.

23. An image forming apparatus according to claim 12, wherein the conveying direction of the transfer material given by said transfer material bearing member includes a vertical component.

24. An image forming apparatus according to claim 23, wherein the conveying direction of the transfer material given by said transfer material bearing member is a substantially upward vertical direction.

25. An image forming apparatus according to any one of claims 12 to 24, further comprising a plurality of transfer means which, upon transferring of the images, are contacted with said transfer material bearing member at said transfer positions to electrostatically transfer the images on said image bearing members onto the transfer material born on said transfer material bearing member.

26. An image forming apparatus comprising:

an image bearing member for bearing an image;

an intermediate transfer member which can convey an image, wherein at a transfer position where said image bearing member is contacted with said intermediate transfer member, the image on said image bearing member is transferred onto said intermediate transfer member;

a first rotating member for supporting said intermediate transfer member most upstream in a conveying direction of the image conveyed by said intermediate transfer [bearing] member; and a second rotating member for supporting said intermediate transfer member most downstream in the conveying direction, wherein a common tangent of said first rotating member and said second rotating member on an image bearing member side is positioned to be offset from and on the image bearing side of the transfer position.

27. An image forming apparatus according to claim 26, wherein a plurality of image bearing members are provided for bearing respective color images, and, at transfer positions where said image bearing members are contacted with said intermediate transfer member, the images on said image bearing members are successively transferred electrostatically onto said intermediate transfer member in a superimposed fashion.

28. An image forming apparatus according to claim 27, wherein a group of lines connecting between adjacent transfer positions protrude toward the side opposite to the side on which said image bearing members are provided.

29. An image forming apparatus according to claim 28, wherein the images on said image bearing members are successively transferred onto said intermediate transfer member in a superimposed fashion at first, second, third and fourth transfer positions.

30. An image forming apparatus according to claim 29, wherein at least one of said second and third transfer positions is positioned on a side, on which said intermediate transfer member is provided, of said first and fourth transfer positions.

31. An image forming apparatus according to claim 30, wherein, in a direction substantially perpendicular to an image conveying direction given by said intermediate transfer member, at least one of said second and third transfer positions is deviated from said first and fourth transfer positions by a distance of 0.5 to 5 mm.

32. An image forming apparatus according to claim 27, further comprising a plurality of transfer means which, upon transferring of the images, are contacted with said intermediate transfer member at said transfer positions to electrostatically transfer the images on said image bearing members onto said intermediate transfer member.

33. An image forming apparatus according to claim 26 or 27, wherein said intermediate transfer member has a belt shape.

34. An image forming apparatus according to claim 26, wherein said first and second rotating members comprise rotatable rollers.

35. An image forming apparatus according to claim 26 or 27, wherein any portion of said intermediate transfer member protruding toward said side on which said image bearing member is provided is not formed in said image conveying surface defined by said intermediate transfer member.

36. An image forming apparatus according to claim 26, further comprising transfer means which, upon transferring of the image, is contacted with said intermediate transfer member at said transfer position to electrostatically transfer the image on said image bearing member onto said intermediate transfer member.

37. An image forming apparatus comprising:

a plurality of image bearing members for bearing respective color images, and an intermediate transfer member, wherein at transfer positions where said image bearing members are contacted with said intermediate transfer member, the images on said image bearing members are successively transferred electrostatically onto said intermediate transfer member in a superimposed fashion, and wherein first, second and third image bearing members are provided in order along an image conveying direction given by said intermediate transfer member, and, a second transfer position where said second image bearing member and said intermediate transfer member are contacted with each other is positioned on a side, on which said intermediate transfer member is provided, of a line connecting between a first transfer position where said first image bearing member and said intermediate transfer are contacted with each other and a third transfer position where said third image bearing member and said intermediate transfer member are contacted with each other.

38. An image forming apparatus according to claim 37, wherein, in a direction substantially perpendicular to the image conveying direction given by said intermediate transfer member, said second transfer position is deviated from said first and third transfer positions by a distance of 0.5 to 5 mm.

39. An image forming apparatus according to claim 38, further comprising a fourth image bearing member disposed between said first and third image bearing members in the image conveying direction given by said intermediate transfer member.

40. An image forming apparatus according to claim 39, wherein said second transfer position and a fourth transfer position where said fourth image bearing member and said intermediate transfer member are contacted with each other are positioned on said side, on which said intermediate transfer member is provided, of the line connecting between said first transfer position and said third transfer position.

41. A An image forming apparatus according to claim 37, wherein said intermediate transfer member has a belt shape.

42. An image forming apparatus according to claim 41, further comprising first and second support members for supporting said intermediate transfer member to define an image conveying surface.

43. An image forming apparatus according to claim 42, wherein said first and second support members comprise rotatable rollers.

44. An image forming apparatus according to claim 43, wherein a tangential line connecting between said first and second support members on a side on which said image bearing members are provided is positioned on said side, on which said image bearing members are provided, of said transfer positions.

45. An image forming apparatus according to claim 37, wherein any portion of said intermediate transfer member protruding toward a side on which said image bearing members are provided is not formed in an image conveying surface defined by said intermediate transfer member.

46. An image forming apparatus according to any one of claims 37 to 45, further comprising a plurality of transfer means which, upon transferring of the images, are contacted with said intermediate transfer member at said transfer positions to electrostatically transfer the images on said image bearing members onto said intermediate transfer member.

* * * * *

UNITED STATES PATENT AND TRADEMARK OFFICE

CERTIFICATE OF CORRECTION

PATENT NO. : 6,477,348 B2
DATED : November 5, 2002
INVENTOR(S) : Takayuki Miyamoto et al.

It is certified that error appears in the above-identified patent and that said Letters Patent is hereby corrected as shown below:

Column 3,
Line 52, “of” should read -- of the --.

Column 4,
Line 37, “informations” should read -- information --.

Column 6,
Line 14, “in” should be deleted.

Column 7,
Line 11, “that-areas” should read -- that areas --.
Lines 18 and 42, “to” should be deleted.

Column 13,
Lines 11 and 30, “born” should read -- borne --.
Line 63, “claims 1-6, 7 or 8-10,” should read -- claims 1-10, --.

Column 14,
Lines 1 and 11, “born” should read -- borne --.

Column 15,
Line 24, “born” should read -- borne --.
Line 37, “[bearing]” should be deleted.

Column 16,
Line 49, “transfer” should read -- transfer member --.

UNITED STATES PATENT AND TRADEMARK OFFICE

CERTIFICATE OF CORRECTION

PATENT NO. : 6,477,348 B2
DATED : November 5, 2002
INVENTOR(S) : Takayuki Miyamoto et al.

It is certified that error appears in the above-identified patent and that said Letters Patent is hereby corrected as shown below:

Column 17,
Line 4, "A" should be deleted.

Signed and Sealed this

Fifteenth Day of July, 2003

JAMES E. ROGAN
*Director of the United States Patent and Trademark Office*